US005915144A

United States Patent [19]

Ide et al.

[11] Patent Number: 5,915,144

[45] Date of Patent: Jun. 22, 1999

[54] MULTICOLOR IMAGE FORMING METHOD

[75] Inventors: Osamu Ide, Minamiashigara; Makoto Niikura, Ninomiya, both of Japan

[73] Assignee: Fuji Xerox Co., Ltd., Tokyo, Japan

[21] Appl. No.: 09/099,418

[22] Filed: Jun. 18, 1998

[30] Foreign Application Priority Data

Jun. 18, 1997 [JP] Japan ..... 9-161723

[51] Int. Cl.[6] ..... G03G 15/00; G03G 15/01

[52] U.S. Cl. ..... 399/45; 399/298; 430/42; 430/45

[58] Field of Search ..... 399/298, 302, 399/308, 45; 430/42, 45, 97, 126

[56] References Cited

U.S. PATENT DOCUMENTS

| | | | |
|---|---|---|---|
| 5,104,765 | 4/1992 | Chowdry et al. | 430/126 |
| 5,234,783 | 8/1993 | Ng | 430/45 |
| 5,260,753 | 11/1993 | Haneda et al. | 399/54 |
| 5,530,532 | 6/1996 | Iino et al | 399/237 |
| 5,780,191 | 7/1998 | Ide | 430/45 |

FOREIGN PATENT DOCUMENTS

| | | |
|---|---|---|
| 63-58374 | 3/1988 | Japan . |
| 63-92965 | 3/1988 | Japan . |
| 7-38084 | 4/1988 | Japan . |
| 63-259575 | 10/1988 | Japan . |
| 3-2765 | 1/1991 | Japan . |
| 4-204670 | 7/1992 | Japan . |
| 4-278967 | 10/1992 | Japan . |
| 5-142963 | 6/1993 | Japan . |
| 5-232840 | 9/1993 | Japan . |
| 5-265287 | 10/1993 | Japan . |
| 7-72696 | 3/1995 | Japan . |
| 9-197858 | 7/1997 | Japan . |

*Primary Examiner*—Matthew S. Smith
*Attorney, Agent, or Firm*—Oliff & Berridge, PLC

[57] ABSTRACT

An image forming method for forming a color image having a high glossiness without deteriorating graininess, color reproducibility, and offset resistance utilizes a transparent toner in addition to color toners and varies an amount of developed transparent toner based on the surface roughness of a transfer material such as an average surface roughness obtained from ten values. It is preferable to control the amount of developed transparent toner so that the amount of developed transparent toner M, the surface roughness Rz and specific gravity W of the transparent toner satisfy the following equation:

$$0.15 \cdot Rz \cdot W \geqq M \geqq 0.06 \cdot Rz \cdot W$$

in which M is an amount of developed transparent toner ($mg/cm^2$) and corresponds to a weight of the developed transparent toner per unit area on a photosensitive member of a solid image, Rz is an average surface roughness (mm) obtained from ten values and W is a specific gravity of toner (g/cm).

20 Claims, 1 Drawing Sheet

MULTICOLOR IMAGE FORMING METHOD

BACKGROUND OF THE INVENTION

1. Field of the Invention

The present invention relates to a method of forming a color image by an electrophotographic system, an electrostatic recording system etc. More particularly, the present invention relates to a method of forming a color image by which graininess, color reproducibility and smoothness are not deteriorated, offset to fixing roll does not occur, and high glossiness can be uniformly reproduced on a transfer material without depending on image density.

2. Description of the Related Art

Conventionally, a color image is formed on a transfer material, e.g., when a color copy is obtained, by an electrophotographic system in such a manner as described below. Namely, light is applied to an original, then the reflected light is separated into colors by a color CCD (charge coupled device), is subjected to image processing by an image processing apparatus and to color correction so as to obtain image signals of multiple colors. The image signals are converted into laser light modulated by using, e.g., a semiconductor laser for each color. The laser light is irradiated on an inorganic photosensitive material, such as selenium (Se) and amorphous silicon, or an organic photosensitive material in which a phthalocyanine pigment, bis-azo pigment, etc. is used for a charge generating layer a plurality of times, with one color at a time so as to form a plurality of electrostatic latent images. The plurality of electrostatic latent images are developed sequentially by using, e.g., four color toners of Y (yellow), M (magenta), C (cyan) and K (black). The developed toner images are then transferred from the inorganic or organic photosensitive material onto a transfer material such as paper, and are heated and fixed thereon by a heat-fixing roll or the like. As a result, a color image is formed on the transfer material.

Meanwhile, in the above-described case, the color toner is, for example, prepared by adhering inorganic fine particles such as silicon oxide, titanium oxide and aluminum oxide or resin fine particles such as PMMA (polymethyl methacrylate), PVDF (polyvinylidene fluoride), having an average particle size of, e.g., 5 to 100 mm, to particles having an average particle size of, e.g., 1 to 15 mm prepared by dispersing a colorant in a binding resin such as polyester resin, styrene/acrylic copolymer and styrene/butadiene copolymer. The above-described colorants include, e.g., bendizine yellow, quinoline yellow and hanza yellow as the Y (yellow), rhodamine B, rose bengal and pigment red as the M (magenta), phthalocyanine blue, aniline blue and pigment blue as the C (cyan), carbon black, aniline black and blends of color pigments as K (black).

Since the surface of the color image by color toners formed as described-above is made smooth during heat-fixing processing, it has a glossiness which is different from that of the surface of a paper. Further, it has been known that the viscosity of the color toner during the heat-fixing processing varies depending on the kind of the binding resin contained in the color toner and the type of heat-fixing system, and that the glossiness of the color image thereby varies.

Although the desired level of glossiness of a color image varies and is different depending on the kind of image, the use to be made of the image, etc., an image having a high glossiness is preferred from the viewpoint of obtaining clear images in the case of a photographic original such as human figures and landscapes. For examples, Japanese Patent Publication No. 5-142963,A, No. 3-2765,A and No. 63-259575,A disclose that an image having a high glossiness is obtained by using a color copying machine and selecting the toner materials and fixing conditions, etc. However, in the case of these techniques described in the publications, although the glossiness of the image area with toner can be increased, the glossiness of a non-image area cannot be increased and the glossiness on a transfer material cannot be uniform.

In order to address the above-described problems, methods of transferring and fixing a transparent toner in addition to color toners to a transfer material are proposed in Japanese Patent Publication No. 63-58374,A, No. 4-278967,A, No. 4-204670,A, No. 5-232840,A No. 7-72696,A. However, the amount of developed transparent toner is not controlled sufficiently with these methods.

An object of the present invention is to address the various problems in the above-described references. Another object of the present invention is to provide a color image forming method and a color image forming apparatus by which an image having a high glossiness can be reproduced uniformly on a transfer material without deteriorating the graininess, color reproducibility and smoothness of the image, and without any occurrence of offset to a fixing roll and without depending on image density.

SUMMARY OF THE INVENTION

As a result of the earnest research by the present inventors to attain these and other objects, the present inventors have found that a color image can be reproduced uniformly on a transfer material with a high glossiness, can be obtained without deteriorating graininess, color reproducibility and smoothness, and without any occurrence of offset to a fixing roll and without depending on image density, by using a transparent toner in addition to color toners, in which the amount of developed transparent toner is determined based on the roughness of the transfer material. The present inventors also have found that it is preferable to calculate digital signals for developing transparent toner in view of a digital signal information for developing color image as described-below. The present invention is made based on the above discoveries by the present inventors.

In a first aspect of the invention, the invention relates to a multicolor image forming method with an electrophotographic system in which a color image is formed using multi-color toners comprising at least cyan toner, magenta toner and yellow toner and a transparent toner, wherein an amount of developed transparent toner to be supplied is determined based on information of surface roughness of a transfer body, wherein by "the amount of developed transparent toner" is meant a weight per unit area of the transparent toner developed on a transfer body of a solid image.

In a second aspect of the invention, a multicolor image forming method with an electrophotographic system is described in which a color image is formed using multicolor toners comprising at least cyan toner, magenta toner and yellow toner and a transparent toner, wherein an amount of developed transparent toner to be supplied is determined based on information of surface roughness of a transfer body, and a digital signal is determined for developing the transparent toner based on information of a digital signal for developing the color image.

In a third aspect of the invention, a multicolor image forming method is described in which the amount of developed transparent toner is determined in order to satisfy the following equation (1), $$0.15 \cdot Rz \cdot W \geqq M \geqq 0.06 \cdot Rz \cdot W \quad (1)$$

in which M is an amount of developed transparent toner ($mg/cm^2$) in terms of a weight per unit area of a transparent toner developed on a photosensitive member of a solid image, Rz is an average surface roughness (mm) obtained from ten values, and W is a specific gravity ($g/cm^3$) of a transparent toner.

In a fourth aspect of the invention, a multicolor image forming method is described in which an amount (M) of developed transparent toner is controlled to satisfy the following equation (1), and an image signal (C) per one pixel of the transparent toner is controlled to satisfy the following equation (2):

$$0.15 \cdot Rz \cdot W \geqq M \geqq 0.06 \cdot Rz \cdot W \quad (1)$$

in which, M is an amount of developed transparent toner ($mg/cm^2$) in terms of a weight per unit area of a transparent toner developed on a photosensitive member of a solid image, Rz is an average surface roughness (mm) obtained from ten values, and W is a specific gravity ($g/cm^3$) of a transparent toner, $$C = \{100 - a/M(M_1 \cdot C_1 + M_i \cdot C_i)\} \quad (2)$$

in which, 1>a>0.3, and when C<0, C is 0, provided that C is an image signal per one pixel of the transparent toner, and $M_1$ to $M_i$ each is a weight per unit area of each color toner developed on a photosensitive member of a solid image, and $C_1$ to $C_i$ each is an image signal per each color toner.

BRIEF DESCRIPTION OF THE DRAWINGS

The FIGURE is a schematic diagram of an example of a color image forming apparatus for effecting the multicolor image forming method of the present invention.

DETAILED DESCRIPTION OF PREFERRED EMBODIMENTS

Figure 1:
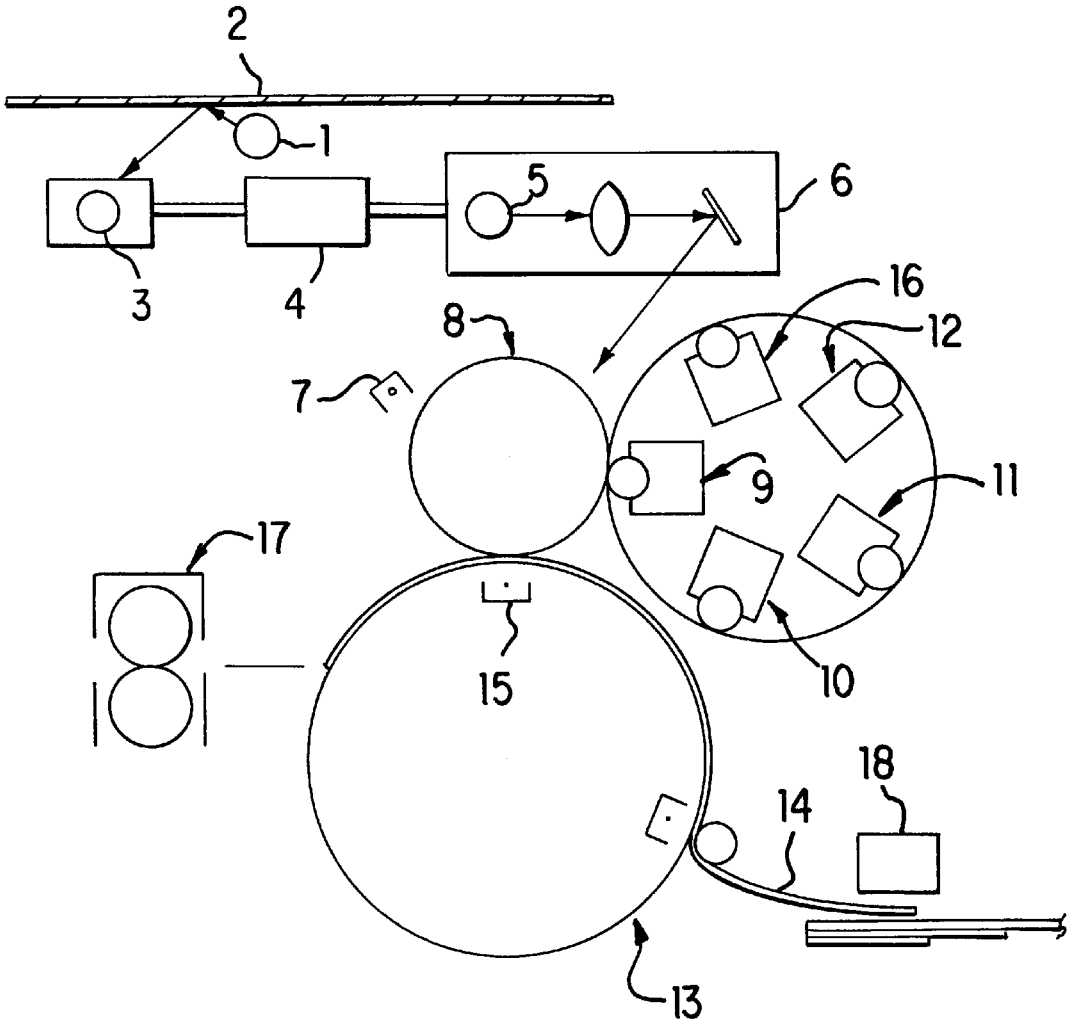

It has been found that when the amount of developed toner is too high, offset of toner to the heat-fixing roll at the time of heat-fixing occurs and images are curled. Further, the present inventors have found that when the amount of developed toner is too low, the toner is stained into the transfer material and a sufficient glossiness cannot be obtained and graininess is deteriorated.

In their investigations for the present invention, the inventors have also found that when art paper for printing having a relatively smooth surface coated with resin and a normal paper for copying having a rough surface not coated with resin are used in combination and the same amount of transparent toners are transferred and fixed, a high glossiness is obtained and an image having a good graininess is obtained in the art paper for printing, but offset of toner to the heat-fixing roll tends to occur. In addition, in the normal paper, offset of toner to the heat-fixing roll does not tend to occur, but a high glossiness can not be easily obtained and graininess is often decreased due to the stain of toner into the substrate material. Further, the inventors have found that if a transparent toner is transferred and fixed to an image having a high image density, offset of toner to heat-fixing roll tends to occur.

A color image forming method according to the present invention includes an image forming process, as well as a fixing process, for example a heat-fixing process. These processes will be explained in detail hereinafter. Meanwhile, the color image forming method of the present invention can be effected appropriately by using the color image forming apparatus as described below. The color image forming apparatus preferably includes at least a developing means and a heat-fixing means.

The above-described image forming process is a process in which a color image is formed on a transfer material with a transparent toner and color toners.

The image forming process is not particularly limited except that transparent toner and color toners are used, and includes conventional and known charging, image exposure, developing, and transfer operations. Further, other operations known in the art, for example, a pre-transfer charging operation, may be also performed as occasion demands.

The above-described transparent toner contains at least binding resin. In the present invention, the term "transparent toner" means toner particles which do not contain color materials used for coloring by light absorption or light scattering (for example, a coloring pigment, a coloring dye, black carbon particles, and black magnetic particles). The transparent toner used in the present invention is usually colorless and transparent. Although the transparency of the toner may become slightly low depending on the kind or amount of agent for improving flowability and release agent contained in the toner, such half transparent toners are included within the meaning of transparent toner of the present invention.

It suffices that the binding resin is substantially transparent, and the binding resin can be appropriately selected depending on the purposes. Examples of the binding resin include known resins conventionally used for an ordinary color toner, for example, polyester resins, polystyrene resins, polyacrylic resins, other vinyl-containing resins, polycarbonate resins, polyamide resins, polyimide resins, epoxy resins, and polyurea resins. Among them, polyester resins are preferable from the view point of providing sufficient overall toner characteristics such as low-temperature fixing property, fixing strength and preservation property.

In order to uniformly obtain a high glossiness in the above-described transparent toner, the flowing property and charging property of toner should be controlled. From the viewpoint of controlling the flowing property and charging property of the transparent toner, the inorganic fine particles and/or organic fine particles are preferably externally added or adhered to the surface of the transparent toner.

The inorganic fine particles are not specifically limited so long as the effects of the present invention are not impaired. Thus, the particles can be selected optionally according to the purpose from the known fine particles known as an external additives. For example, inorganic fine particles made of materials such as silica, titanium dioxide, stannic oxide and molybdenum oxide may be used. In addition, from the viewpoint of stability such as of charging property, the inorganic fine particles may be used after making them hydrophobic using a silane coupling agent, a titanium coupling agent, etc.

The organic fine particles are not specifically limited so long as the effects of the present invention are not impaired. Thus, these particles can be selected optionally according to the purposes from the known materials known as external additives. For example, resin fine particles made of a material such as, for example, polyester resin, polystyrene resin, polyacrylic resin, vinyl resin, polycarbonate resin, polyamide resin, polyimide resin, epoxy resin, polyurea resin and fluorine-containing resin, may be used.

The average particle diameter of the inorganic fine particles and organic fine particles is most preferably from 0.005 to 1 mm. If the average particle diameter is less than 0.005 mm, agglomeration may occur when the inorganic fine particles and/or resin fine particles are adhered onto the surface of the transparent toner, and thus the desired effects may not be obtained. On the other hand, if the average particle diameter exceeds 1 mm, more glossy images may not be obtained easily.

In addition, a release agent is preferably added in order to avoid offset to the fixing roll in the heat-fixing. The release agent is not specifically limited so long as the effects of the present invention are not impaired, and it can be selected optionally according to the purpose from the known materials used as release agents. For example, a release agent made of a material such as polyethylene resin and polypropylene may be used.

The above-described color toners include at least a binding resin and a colorant, and a cyan toner, magenta toner, yellow toner, black toner, etc. are included. The composition and average particle diameter of the above color toners are selected appropriately from ranges which do not impair the objects of the present invention, which selections are readily understood and made by practitioners in the art.

As the binding resin, the above-described examples of the binding resins in the transparent toner may be used. In addition, the colorant is not particularly limited so long as it is a colorant ordinarily used for toner, and thus it can be selected from the cyan pigment or dye, magenta pigment or dye, yellow pigment or dye and black pigment or dye, which are themselves known. In order to improve the effects of obtaining high glossiness, it is important to preferably avoid irregular reflection on the interface of the pigment of the colorant and binder. In this regard, a combination of the pigment having a small particle size described in Japanese Patent Publication No. 4-242752,A, incorporated herein by reference, and a colorant in which the pigment is highly dispersed may preferably be used.

In the present invention, the above-described color toners may be prepared or may be a commercially available product.

Meanwhile, the above-described transparent toner and color toner are used as a developer in such a manner as to be combined with a carrier which is appropriately selected and is itself known. Further, a method can be applied in which these toners are each provided as a one-component developer to allow frictional charging with a developing sleeve or a charging member to form a charging toner and then development process is effected in accordance with an electrostatic latent image.

Each operation in the above-described image forming process is as follows.

The charging is an operation in which the surface of a latent image holder which holds a latent image thereon, for example an electrophotographic photosensitive member, is charged. For example, a contact charging using a conductive or semi-conductive roller, brush, film, or rubber blade, and corotron or scorotron charging utilizing a corona discharge are exemplified. The above-described electrophotographic photosensitive member is not particularly limited and known ones may be used, and a single-layer structure type or a multi-layer and function-separated type may be used. In addition, as the material of the photosensitive member, an inorganic material such as selenium, amorphous silicon, etc. and an organic material can be used, for example. As the above-described developing apparatus, for example, a charging device which is known itself, such as contact charging device with a conductive or semi-conductive roller, brush, film, or rubber blade, and a corotron or scorotron charging apparatus utilizing a corona discharge, may be used.

The image exposure is an operation in which a charged surface of an electrophotographic photosensitive member is exposed in an imagewise manner to form an electrostatic latent image thereon. As an image exposing device, for example, an optical apparatus, which is itself known and can expose the image in a desired manner utilizing a known light source such as LED light, in addition to a semiconducting laser, may be used.

The developing operation is an operation in which the electrostatic latent image is developed by using a toner to form a color image, and can be implemented by, for example, using a developing apparatus which allows development processing with contacting or non-contacting the toner with the above-described photosensitive member. At this time, a developing method in which a carrier is used in a two-component developer or a developing method in which no carrier is used in a one-component developer, as known in the art, may be used. Further, in the present invention, as for the toner, any of the foregoing ones may be used.

As the developing apparatus, for example, a known developing apparatus is used which has a function of causing toner to adhere to the electrophotographic photosensitive member by using a brush, a roller, etc. However, the developing apparatus in the color image forming apparatus of the present invention has a function of effecting development processing by using the transparent toner and the color toners (C, M, Y, K). A developing apparatus comprising a transparent toner developing apparatus, a cyan toner developing apparatus, a magenta toner developing apparatus, a yellow toner developing apparatus and a black toner developing apparatus provided at the circumferential portion of a rotating body may be used.

The transfer operation is an operation in which the image is transferred onto a transfer material at a transfer station. For example, a transfer operation using a corona discharge and a contact transfer operation using a transfer belt or a transfer roller are used. As the transfer apparatus, for example, a known transfer charging device such as a contact transfer device using a transfer belt, a transfer roller, and a corotron or scorotron transfer device utilizing a corona discharge, are exemplified. Meanwhile, the color image formed on the electrophotographic photosensitive member may be directly transferred onto the transfer material or may be transferred thereon after having been temporarily transferred onto an intermediate transfer material.

The fixing is an operation in which a color toner image transferred on a transfer material is fixed on the transfer material, which can be carried out using, e.g., a known fixing apparatus such as heat-fixing by which toner is melted and deformed utilizing heat and pressure using a heat roll and press roll to fix, an oven fixing by which toner is melted utilizing heat to fix, and radiant fixing. The fixing apparatus includes, for example, a heat roll fixing apparatus by which toner is melted and deformed using a heat roll and press roll to fix, a heat roll fixing apparatus, an oven apparatus and a radiant apparatus.

Meanwhile, the transfer material is not specifically limited provided that it is capable of maintaining toner on the surface to maintain an image, and includes commercially available paper and art paper for printing, etc., which are known themselves.

The above-described image forming process can be appropriately implemented by using developing means in the color image forming apparatus of the present invention. The developing means has a function of developing a color image with toners on a transfer material, and also includes an electrophotographic photosensitive member, a charging device, an image exposing device, a developing machine, a transfer-charging device, a fixing device, etc. Further, the developing means may include other equipment, for example, a pre-transfer charging device as occasion demands.

Formation of a color image on the transfer material by using the transparent toner and the color toners which are mixed with a known carrier and charged, can be implemented in accordance with a known method, e.g., as described in Japanese Patent Publication No. 63-58374,A. For example, an electrophotographic photosensitive member is, first, charged with the charging device. The electrophotographic photosensitive member is exposed by the image exposure device in an image wise manner to allow formation of an electrostatic latent image thereon. The electrostatic latent image is developed by the developing machine equipped with the transparent toner and the color toners, and a color image by the transparent toner and the color toners is thereby formed on the electrophotographic photosensitive member. The color image is then transferred onto the transfer material. Alternatively, a color image may be formed by employing a developing method using a one-component developer having no carrier.

At this time, the color image formed on the electrophotographic photosensitive member may be directly transferred onto the transfer material or may be transferred thereon after having been temporarily transferred onto an intermediate transfer material.

The order in which the transparent toner and the color toner are transferred in the color image is not particularly limited and thus it can be selected optionally according to the purpose. For example, charging, exposing and developing are effected as to the transparent toner, and the transparent toner is first adhered to the electrophotographic photosensitive member or to the intermediate transfer material, and then charging, exposing and developing operations are effected as to the color toners, and the color toners are overlaid on the electrophotographic photosensitive member or the intermediate transfer material on which the transparent toner is adhered. This operation is repeated by the number of color toners, and after forming a developed image by a plurality of toners on the electrophotographic photosensitive member or the intermediate transfer member, the plurality of toners may be transferred together onto the transfer material. In this case, if the intermediate transfer member is not used, the outermost surface of the color image will be a transparent toner, and if the intermediate transfer body is used, the lowest layer of the color image will be transparent. In addition, after transferring a developed image by the above-described color toner to the above-described transfer material, the transparent toner may be transferred onto the transfer material. In this case, the outermost surface of the color image transferred onto the transfer material, is a layer with the transparent toner.

The transparent toner is preferably developed on a non-image portion of the multi-color image, i.e., a portion of the image that is not developed with any of the color toners.

A preferable image can be obtained by varying the amount of developed transparent toner applied based on information concerning the surface roughness of a transfer material. An image having a uniform glossiness regardless of image density, a good graininess and a good color reproducibility can be provided without offset of toner to a fixing roll, by increasing the amount of developed transparent toner when a transfer material having a high surface roughness is utilized, and by decreasing the amount of developed transparent toner when a transfer material having a low surface roughness is utilized.

As the surface roughness Rz of the above-described transfer material, data which has been previously determined for that transfer method by a known surface roughness-determining apparatus such as, for example, a feeler-type surface roughness-determining apparatus, may be used. In addition, the determination and calculation of the Rz can be carried out according to standard methods described in, for example, JIS (Japanese Industrial Standards), etc.

By "amount of developed transparent toner" in the present specification is meant a weight of the transparent toner developed on a photosensitive member of a solid image per unit area. More specifically, this phrase means a weight of the transparent toner developed on a photosensitive member per unit area when an exposure data of image signal C=100 (%) is input in an exposing apparatus.

"Image signal C" as used in the present specification is an image signal corresponding to a lighting time ratio (%) or a lighting strength rate (%) in one pixel when laser lighting time or strength, etc., is modulated so as to control the amount of developed transparent toner per one pixel. By varying C, the exposure area or strength of laser per one pixel is changed and thus the transparent toner developed per one pixel can be effectively controlled.

The multicolor image formation of the present invention in which the amount of developed toner to be applied based on the surface roughness of a transfer body is preferably controlled so that the amount of developed transparent toner (M) is less than 0.15·Rz·W, and most preferably satisfies the following equation (1):

$$0.15Rz\cdot W \geqq M \geqq 0.06\cdot Rz\cdot W \quad (1)$$

in which M is the amount of developed transparent toner ($mg/cm^2$) and represents a weight of transparent toner developed on a photosensitive member of a solid image per unit area, Rz is a surface roughness (mm) of a transfer material obtained from ten values, and W is a specific gravity ($g/cm^3$) of the transparent toner.

When M is more than 0.15·Rz·W, an offset of toner to a fixing roll may occur when an image has a high density. When M is less than 0.06·Rz·W, the glossiness may be changed based on image density, graininess may be deteriorated and color reproducibility may be decreased since the surface structure of the transfer material remains on an image when an image has low density.

In the present invention, more preferably, the amount (M) of developed transparent toner to be applied in the image is controlled to satisfy the following equation (1), and the image signal (C) of transparent toner per one pixel is controlled to satisfy the following equation (2):

$$0.15\cdot Rz\cdot W \geqq M \geqq 0.06\cdot Rz\cdot W \quad (1)$$

in which M is an amount of developed transparent toner ($mg/cm^2$) and represents a weight of transparent toner developed on a photosensitive material of a solid image per unit area, Rz is an average surface roughness (mm) obtained from ten values, and W is a specific gravity ($g/cm_3$) of the transparent toner.

$$C=\{100-a/M(M_1\cdot C_1+M_i\cdot C_i)\} \quad (2)$$

in which 1>a>0.3 and C=0when C<0.

C is an image signal of transparent toner per one pixel and has the same meaning as described above, and M has the same meaning as described in the above equation (1). $M_1$to $M_i$ represent a weight of each color toner developed on a photosensitive member of a solid area per unit area, and $C_1$ to $C_i$ represent an image signal of each color toner per one pixel. $M_1$ to $M_i$ shows practically a weight of color toner developed on a photosensitive member per unit area when an exposure data of C=100% is input in an exposing device. Meanwhile, the $C_1$ to $C_i$(%) herein is an image signal corresponding to lighting time ratio (%) and lighting strength rate (%) in one pixel when a laser lighting time or strength is modulated in order to control the amount of developed each color toner per one pixel. By varying $C_1$ to $C_i$, the exposure area or strength of a laser per one pixel is changed, and thus an amount of each color toner developed per one pixel can be effectively controlled.

The image signal per one pixel of a transparent toner is controlled in order to satisfy the following equation (3):

$$C=\{100-a/M(M_c\cdot C_c+M_m\cdot C_m+M_y\cdot C_y+M_k\cdot C_k)\} \quad (3)$$

in which when 1>a>0.3, C is 0, provided that each weight per unit area of cyan toner, magenta toner, yellow toner and black toner developed on a photosensitive body of a solid image is to be $M_c$ (mg/cm$^2$), $M_m$(mg/cm$^2$), $M_y$(mg/cm$^2$), $M_k$(mg/cm$^2$), respectively, and each image signal (image data) per one pixel of cyan toner, magenta toner, yellow toner and black toner is to be $C_c$(%), $C_m$(%), $C_y$(%) and $C_k$(%), respectively.

When M is more than 0.15·Rz·W, an offset of toner to a fixing roll tends to occur. In addition, when M is less than 0.06·Rz·W, the glossiness may be changed due to the image density, the graininess may be deteriorated, and the color reproducibility may be decreased since the surface structure of the transfer material remains on an image. In addition, when a is 0.3 or less, an offset of toner to the fixing roll tends to occur in a high density image area. In addition, when a is 1 or more, the glossiness may be changed due to image density, the graininess may be deteriorated and the color reproducibility may be decreased since the surface structure of the transfer material and the image structure of color toner remains on an image.

In one preferred embodiment of the invention, when the surface roughness of the transfer material is less than 5.0 Rz, the amount of developed transparent toner should be less than 0.8 mg/cm$^2$ in order to obtain the desired glossiness.

As a method of controlling the amount of developed transparent toner based on the surface roughness of a transfer body, methods in which developing bias and/or charging potential and/or exposure light amount, etc. are varied so that the electrostatic contrast of surface potential of a photosensitive body and developing sleeve are changed may be used. In addition, a method by which rates of surface speed of the developing sleeve and the photosensitive body are varied may also be used. In addition, a method in which rates of concentration of toner and carrier are varied in the case of a two-component developing system may also be used. Meanwhile, the method of controlling the amount of developing is not specifically limited and all controlling method for the amount of developing which are known themselves can be used, so long as the methods have functions to change the amount of developing.

It is preferable to calculate an optimal Cin (exposure data) of a transparent toner in the image processing process, based on each weight of the color toners developed on the photosensitive body of a solid image per unit area which has been determined, and on the rate of area (%) (image data) of the color toner occupied in one pixel. Control of the above C, $C_1$ to $C_i$ in equations (2) and (3) is made by varying exposure time per unit area or exposure strength, etc.

In a most preferred embodiment of the invention, information concerning the surface roughness of a transfer material is first determined or retrieved. Based upon the surface roughness for the transfer material, the amount of developed transparent toner to be applied per unit area, for example per pixel, is determined and adjusted through one of the foregoing methods of controlling the amount of developed transparent toner. Most preferably, the amount of developed transparent toner per each unit of color image is adjusted by changing the developing bias. The amount of developed transparent toner to be utilized is determined in accordance with the requirements of equation (1).

Subsequently, based upon the rate of image data of each color toner in a given single pixel, C (exposure data) is determined for that pixel in accordance with the appropriate equation (2) or (3). Control of C is then made most preferably by varying the exposure time per pixel so that the amount of developed transparent toner in a pixel is appropriately distributed within the pixel in conjunction with the amount of color toner in the pixel.

Following obtaining of the foregoing information for the amount of transparent toner and C, the image forming process is then conducted.

In this process, optimal glossiness is obtained for all images regardless of the type of transfer material used as the process accounts for both surface roughness and color toner amounts in order to apply the ideal amount of developed transparent toner in each unit of the color image (e.g., each pixel).

In one aspect of the invention, when a user inputs the kind of a transfer material being used into an input device, data on the surface roughness of the transfer material that has been previously determined and stored is retrieved, and an optimal amount of developed transparent toner is calculated based on the data of the surface roughness.

Next, one example of the color image forming method of the present invention which is implemented using a color image forming method will be explained with reference to the drawings. The FIGURE is a schematic diagram for illustrating an example of the color image forming apparatus of the present invention.

The image forming means in a color image forming apparatus shown in the FIGURE includes a charging device 7 as the above-described charging device, an organic photosensitive member 8 as the above-described electrophotographic photosensitive member, an illumination device 1 as the above-described image exposure device, a color CCD 3, an image processor 4, a laser diode 5 and an optical system (ROS) 6, which serve as the above-described image exposure device, a yellow developing apparatus 9, a magenta developing apparatus 10, a cyan developing apparatus 11, a black developing apparatus 12, transparent toner developing apparatus 16, which serve as the above-described developing apparatus, a transfer corotron 15 as the above-described transfer charging device, which is disposed toward the organic photosensitive member 8 via a transfer drum 13, and a heat roll fixing device 17 as the above-described heat-fixing device.

When a color copy is obtained by using the color image forming apparatus shown in the FIGURE, light from the illumination device 1 is first applied onto an original from which a copy is obtained, and light reflected is separated into colors by the color CCD 3 and is subjected to image processing and color correction in the image processor 4 to obtain image data of a plurality of color toners. The obtained image data of a plurality of color toners and the image data (image signal) of transparent toner determined with an image processing apparatus by the equation 3 based on an amount of developed color toners, image data (image signal) and an amount of developed transparent toner, are converted into laser light modulated by using the laser diode 5 for each of the colors. The amount of developed color toners is decided by a developing amount-controlling means of an ordinary A Color by which rate of concentration of toner and carrier is varied by controlling the amount of supplied toner based on information from the developing amount-detecting apparatus. The amount of developed transparent toner is determined by the equation (1) based on information of roughness of transfer material which has been previously input by a user or determined by an image processing device, and is controlled by varying developing bias, or varying the rate of concentration of toner and carrier. The laser light is applied onto the organic photosensitive member 8 a plurality of times, one color at a time, so as to form a plurality of electrostatic latent images thereon.

These plurality of electrostatic latent images are developed sequentially in the yellow developing apparatus 9, the magenta developing apparatus 10, the cyan developing apparatus 11, the black developing apparatus 12, and the transparent toner developing apparatus 16 by using the four color toners of yellow, magenta, cyan and black as well as the transparent toner. The developed color toner image is transferred from the organic photosensitive member 8 onto the transfer material 14, such as paper fed by paper feeder 18, by transfer corotron 15, and is heated and fixed by the heat roll fixing device 17. As a result, a color image is formed on the transfer material 14.

EXAMPLES

Examples of the present invention will be described. However, the present invention is not limited to the same.

Example 1

Color toner developer

As the color toner developers used in the following Examples, a cyan developer, a magenta developer, a yellow developer and a black toner for A-color, manufactured by Fuji Xerox Co., Ltd., are used. The specific gravity of the color toner is 1.1 g/cm$^3$.

Transparent toner developer

Transparent toner prepared by using linear polyester obtained from terephthalic acid/bisphenol A ethylene oxide adduct/cyclohexanedimethanol (mole ratio is 5:4:1, Tg=62, Mn=4500, Mw=10000) is used. The resin is pulverized with a jet-mill, and classified with a pneumatic classifier to obtain transparent fine particles (d=50, 7 mm). The following two inorganic fine particles A and B are adhered to 100 parts by weight of the transparent fine particles to obtain the transparent toner. The determination of molecular weight is made by gel-permeation chromatography. As a solvent, tetrahydrofuran is used.

The inorganic fine particles A are $SiO_2$ (the surface is made hydrophobic with a silane coupling agent, average particle size: 0.05 mm, amount added: 1.1 parts by weight). The inorganic fine particles B are $TiO_2$ (the surface is made hydrophobic with a silane coupling agent, average particle size: 0.02 mm, reflective index: 2.5, amount added: 1.4 parts by weight). The average particle size is determined with a Coulter counter, and d50 of weight average is applied.

8 parts by weight of the transparent toner obtained in such a manner is added to 100 parts by weight of a carrier made of spherical ferrite particles having a particle size of about 50 mm which has been coated with styrene methylnethacrylate copolymer and mixed with a tubular shaker mixer to obtain a two-component developer for the transparent toner.

The transparent toner has a specific gravity (W) of 1.1 g/cm$^3$.

A method of forming color image

As for the image forming apparatus, a modified A-color 630, manufactured by Fuji Xerox Co., Ltd. is used. This is the same as the above-described color image forming apparatus shown in the FIGURE. The operation of the color image forming apparatus shown in the FIGURE has been already described.

Transfer Material

As the transfer materials used in the color image formation, J paper (color paper, Rz=8.0 mm, manufactured by Fuji Xerox Co., Ltd.), R paper (recycled paper, Rz=11.0 mm) and OK Special Art paper (Rz=3.0 mm; manufactured by Shin Oji Seishi Co., Ltd.) are used.

Weight of color toner on a photosensitive material of a solid image, and image signal (C) per one pixel The weight of each color toner developed is to be 0.7 mg/cm$^2$ in an area where C is 100%. As described in each of the items of evaluations for offset, graininess and color reproducibility and determination of glossiness, image signal $C_i$ per one pixel of a color toner is determined. In addition, in the organoleptic evaluation, an image signal $C_i$ per one pixel of a color toner is determined by an image signal obtained by placing an original described below on a platen of A color, making a color separation with an image input apparatus of an ordinary A color, and carrying out an image processing in the same manner as the ordinary A Color using an image processing apparatus.

For J paper and the transparent toner having a specific gravity of 1.1 g/cm$^3$, then, using equation (1), $1.32 \geqq M \geqq 0.528$. For R paper, $1.815 \geqq M \geqq 0.726$. For Special Art paper, $0.495 \geqq M \geqq 0.198$.

Weight (M) of developed transparent toner on a photosensitive member of a solid image of transparent toner, and image signal (C) at one pixel The amounts of developed transparent toner in an area where C is 100%, are to be 0.80, 1.10 and 0.30 mg/cm$^2$ for J paper, R paper and OK Special Art paper, respectively.

The image signal per one pixel of a transparent toner is calculated according to the following equation wherein the a is 0.5.

$$C=\{100-a/M(M_c \cdot C_c+M_m \cdot C_m+M_y \cdot C_y+M_k \cdot C_k)\}$$

in which, a=0.5 and C=0 where C<0.

Then, methods of evaluating the obtained images will be shown hereinafter.

Evaluation for Offset

The evaluation for offset to the fixing roll is made on an image developed with a transparent toner on a process black image prepared with making $C_i$ of each of cyan toner, magenta toner and yellow toner 100%, with calculating a developed amount and image signals of the transparent toner in the method as described above. A case in which no offset occurs is regarded as ○, a case in which no fault is observed on an image although a little offset occurs is regarded as Δ, and a case in which offset occurs and faults are observed on an image is regarded to as X.

Evaluation for Graininess

The evaluation for graininess is made visually by employing uniform cyan images of 2 cm×2 cm each having 10%, 50% and 100% of image signals ($C_c$). The evaluation is made based on five steps described below by 20 evaluators.

1 . . . very coarse-grained

2 . . . coarse-grained

3 . . . ordinary

4 . . . fine-grained

5 . . . very fine-grained

Then, the average value thereof are obtained and evaluations are made based on the following criteria.

X . . . when the average value is less than 2

Δ . . . when the average value is 2 or more and less than 4

○ . . . when the average value is 4 or more

Evaluation for Color Reproducibility

As for the determination of the color reproducibility, the image density of an image developed on a magenta image having 100% of magenta image signal by a transparent toner with a transparent toner image signals obtained from the method described above using X-rite 404 (manufactured by X-rite Co., Ltd.), is determined and evaluated based on the following criteria.

X . . . less than 1.4

Δ . . . 1.4 or more and less than 1.7

○ . . . 1.7 or more

Organoleptic Evaluation for Image

The organoleptic evaluation is made based on visual evaluation of a copied image of a human figure photograph as the original. The evaluation is made at five steps described below by 20 evaluators.

1 . . . very bad

2 . . . bad

3 . . . ordinary

4 . . . good

5 . . . very good

The average values thereof are then obtained, and evaluation is made based on the following criteria.

X . . . less than 2

Δ . . . 2 or more and less than 4

○ . . . 4 or more

Determination of Glossiness

The determination of glossiness of an image is made using Gloss Meter GM-26D (manufactured by Murakami Color Technical Research Institute). An incident angle of light on an image is set 75 degrees.

One evaluation for image is made on an image developed with a transparent toner on uniformly cyan image having 10%, 50% and 100% of cyan image signal ($C_c$), with calculation of image signals of transparent toner in the method as described above. Another evaluation for image is made on an image developed with a transparent toner on a process gray image having 50% of each cyan image signal and magenta image signal and yellow image signal, with calculation of image signals of transparent toner in the method as described above. The other evaluation for image is made on an image developed with a transparent toner on a process black image having 100% of each cyan image signal and magenta image signal and yellow image signal, with calculation of image signals of transparent toner in the method as described above. The other evaluation for image is made on an image developed with only a transparent toner on no image having 0% of all color image signals, with calculation of image signals of transparent toner in the method as described above.

The maximum value of these differences in glossiness of the images are determined and evaluation is made based on the following criteria.

X . . . when the difference in glossiness is 30 or more

Δ . . . when the difference in glossiness is 15 or more and less than 30

○ . . . when the difference in glossiness is 15 or less

Example 2

A color image is formed in the same manner as described in Example 1 except that an area ratio of a transparent toner occupying in one pixel is made to be C=100% in all images.

Example 3

A color image is formed in the same method as described in Example 1 except that the weight ($M_1$ to $M_i$, M) of the developed color toners and transparent on a photosensitive member of a solid image, and the image signal (C) per one pixel of the transparent toner are changed as follows (the image signal $C_i$ of the color toner is determined as described in Example 1).

$M_i$ of color toner

The $M_i$ of each of the color toners developed is to be 0.5 mg/cm$^2$ in the area where C is 100%.

M and C of transparent toner

The M of the transparent toner in the area where C is 100% is to be 1.15, 1.60 or 0.45 mg/cm$^2$ in J paper, R paper or OK Special Art paper, respectively. The image signal C per one pixel of the transparent toner is calculated by the following equation, provided that the a is 0.7 in the above equation (3) by image processing.

$$C=\{100-a/M(M_c\cdot C_c+M_m\cdot C_m+M_y\cdot C_y+M_k\cdot C_k)\}$$

in which a=0.7, and C=0 when C<0.

Comparative Example 1

A color image color image is formed in the same manner as described in Example 1 except that the transparent toner is not used.

Comparative Example 2

A color image is prepared in the same manner as described in Example 1 except that the weight (M) of developed on a photosensitive material of a solid image of a transparent toner and the image signal (C) per one pixel of a transparent toner are changed as follows.

Weight (M) of developed transparent toner on a photosensitive member of a solid image The amount of developed transparent toner on the area where C is 100% is to be 1.5 mg/cm$^2$ in all cases in which the transfer materials are J paper, R paper and OK Special Art paper. In all cases, the amount of developed transparent toner is outside the range required by equation (1).

Image signal (C) per one pixel

C is to be 100% over all of the image. In other words, C is not varied as in the present invention.

Comparative Example 3

A color image is prepared in the same manner as described in Example 1 except that the weight (M) of developed on a photosensitive material of a solid image of a transparent toner, and the image signal (C) per one pixel of a transparent toner are changed as follows.

Weight M of developed transparent toner on a photosensitive member of a solid image The amount of developed transparent toner on the area where C is 100% is to be 0.5 mg/cm$^2$ in the all cases in which the transfer materials are J paper, R paper and OK Special Art paper. For J paper and R paper, this amount is outside the range required by equation (1). For OK Special Art paper, the amount is just outside the range required by equation (1), but should be considered to be within the range due to the closeness in values since in this case, 0.15·Rz·W is 0.495(Rz=3.0 mm, W=1.1 g/cm$^3$) and M is 0.5, which is about the same.

Image signal (C) per one pixel

C is to be 100% over all of the image.

The results of the evaluations of the color images obtained in the Examples and Comparative Examples are shown in Table 1.

TABLE 1

| | | Offset | Graininess | Color Reproducibility | Difference in Glossiness | Organoleptic Evaluation |
|---|---|---|---|---|---|---|
| Ex. 1 | J Paper | ○ | ○ | ○ | ○ | ○ |
| | R paper | ○ | ○ | ○ | ○ | ○ |
| | Art Paper | | | | | |
| Ex. 2 | J Paper | ○ | ○ | ○ | Δ | ○ |
| | R Paper | ○ | ○ | ○ | Δ | Δ |
| | Art Paper | Δ | ○ | ○ | ○ | Δ |
| Ex. 3 | J Paper | ○ | Δ | ○ | ○ | Δ |
| | R Paper | ○ | Δ | Δ | Δ | Δ |
| | Art Paper | Δ | ○ | ○ | ○ | ○ |
| Comp | J Paper | ○ | Δ | Δ | X | X |
| Ex. 1 | R Paper | ○ | X | X | X | X |
| | Art Paper | ○ | ○ | ○ | Δ | Δ |
| Comp | J Paper | X | ○ | ○ | Δ | X |
| Ex. 2 | R Paper | Δ | ○ | ○ | ○ | ○ |
| | Art Paper | X | ○ | ○ | X | X |
| Comp | J Paper | ○ | Δ | Δ | Δ | Δ |
| Ex. 3 | R paper | ○ | X | X | X | X |
| | Art Paper | Δ | ○ | ○ | ○ | ○ |

With the present invention, a high quality color image which has a uniform glossiness without depending on image density, a good graininess, a high color tone and a smoothness, can be reproduced in an electrophotographic system.

What is claimed is:

1. A multicolor image forming method for an electrophotographic system comprising a color image with multicolor toners comprising at least cyan toner, magenta toner and yellow toner and a transparent toner, wherein an amount of developed transparent toner is varied based on a surface roughness of a transfer material, and the amount of the developed transparent toner is a weight of the developed transparent toner per unit area on a photosensitive member of a solid image.

2. A multicolor image forming method according to claim 1, wherein the amount of the developed transparent toner is varied by varying digital signals based on the surface roughness of a transfer body.

3. A multicolor image forming method according to claim 1, wherein the surface roughness of a transfer body is an average surface roughness obtained by ten values.

4. A multicolor image forming method according to claim 1, wherein the amount of the developed transparent toner is varied based on an average surface roughness obtained by ten values to satisfy the following equation (1), $$0.15\cdot Rz\cdot W \geqq M \geqq 0.06\cdot Rz\cdot W \quad (1)$$

in which M is the amount of developed transparent toner (mg/cm$^2$) and is the weight of the developed transparent toner per unit area on a photosensitive member of a solid image, Rz is an average surface roughness (mm) obtained from ten values, and W is a specific gravity (g/cm$^3$) of the transparent toner.

5. A multicolor image forming method according to claim 1, wherein the transparent toner is developed on a non-image portion.

6. A multicolor image forming method according to claim 1, wherein the amount of the developed transparent toner is varied to satisfy the following equation (1) based on an average surface roughness obtained from ten values of the transfer material, and an image signal (C) per one pixel of the transparent toner is varied to satisfy the following equation (2), $$0.15\cdot Rz\cdot W \geqq M \geqq 0.06\cdot Rz\cdot W \quad (1)$$

in which M is an amount of the developed transparent toner (mg/cm$^2$) and is the weight of the developed transparent toner per unit area on a photosensitive member of a solid image, Rz is the average surface roughness (mm) obtained from ten values, and W is a specific gravity (g/cm$^3$) of a toner, $$C=\{100-a/M(M_1\cdot C_1+M_i\cdot C_i)\} \quad (2)$$

in which, 1>a>0.3, and when C<0, C=0, wherein C is an image signal per one pixel of the transparent toner, and $M_1$ to $M_i$ each is weight of each color toner per unit area developed on a photosensitive member of a solid image, and $C_1$ to $C_i$ each is an image signal per one pixel of each color toner.

7. A multicolor image forming method according to claim 1, wherein the transparent toner contains inorganic fine particles, resin fine particles or both.

8. A multicolor image forming method according to claim 7, wherein an average particle size of the inorganic fine particles, resin fine particles or both is from 0.005 to 1 mm.

9. A multicolor image forming method for an electrophotographic system, comprising determining a surface roughness of a transfer material upon which a color image is to be formed, determining an amount of developed transparent toner per unit area of the color image based upon the surface roughness of the transfer material, wherein the amount of the developed transparent toner is a weight of the developed transparent toner per unit area on the photosensitive member of a solid image, forming a color image upon a photosensitive member in the unit area with color toner and the determined amount of developed transparent toner, and transferring the color image to the transfer material.

10. A multicolor image forming method according to claim 9, wherein the determining of the surface roughness is conducted by measuring the surface roughness of the transfer material with a surface roughness determining apparatus.

11. A multicolor image forming method according to claim 9, wherein the determining of the surface roughness comprises receiving input identifying the kind of transfer material, and retrieving the surface roughness for the transfer material from stored data.

12. A multicolor image forming method according to claim 9, wherein the amount of the developed transparent toner is varied per unit area of the color image by one or more methods selected from the group consisting of varying developing bias, varying charging potential, varying exposure light amount, varying rates of surface speed between the photosensitive member and a development apparatus and varying the concentration between amounts of toner and carrier.

13. A multicolor image forming method according to claim 9, wherein the amount of the developed transparent toner is varied based on an average surface roughness obtained by ten values to satisfy the following equation (1), $$0.15 \cdot Rz \cdot W \geqq M \geqq 0.06 \cdot Rz \cdot W \quad (1)$$

in which M is the amount of developed transparent toner ($mg/cm^2$) and is the weight of the developed transparent toner per unit area on a photosensitive member of a solid image, Rz is an average surface roughness (mm) obtained from ten values, and W is a specific gravity ($glcm^3$) of the transparent toner.

14. A multicolor image forming method according to claim 9, wherein the method further comprises, following determining the amount of developed transparent toner but prior to the forming of the color image, determining exposure data for an image signal for the developed transparent toner in the unit area based upon a rate of image data of each color toner in the unit area.

15. A multicolor image forming method according to claim 14, wherein the exposure data per unit area of the color image is varied by varying exposure time.

16. A multicolor image forming method according to claim 14, wherein the amount of the developed transparent toner is varied to satisfy the following equation (1) based on an average surface roughness obtained from ten values of the transfer material, and an image signal (C) per one pixel of the transparent toner is varied to satisfy the following equation (2), $$0.15 \cdot Rz \cdot W \geqq M \geqq 0.06 \cdot Rz \cdot W \quad (1)$$

in which M is an amount of the developed transparent toner ($mg/cm^2$) and is the weight of the developed transparent toner per unit area on a photosensitive member of a solid image, Rz is the average surface roughness (mm) obtained from ten values, and W is a specific gravity ($g/cm^3$) of a toner, $$C = \{100 - a/M(M_1 \cdot C_1 + C_i)\} \quad (2)$$

in which, 1>a>0.3, and when C<0, C=0, wherein C is an image signal per one pixel of the transparent toner, and $M_1$ to $M_i$ each is weight of each color toner per unit area developed on a photosensitive member of a solid image, and $C_1$ to $C_i$ each is an image signal per one pixel of each color toner.

17. Image forming apparatus for forming a color image on a transfer material from multiple toners comprising at least cyan toner, magenta toner, yellow toner and transparent toner, the apparatus comprising a device which receives input identifying a kind of the transfer material and retrieves stored data on the surface roughness of the kind of the transfer material, a latent image holder for holding a latent image;

a developing apparatus for each of the multiple toners, wherein a developing apparatus for the transparent toner varies the amount of developed transparent toner based upon the surface roughness of the transfer material, wherein the amount of developed transparent material is a weight of the developed transparent toner per unit area on the latent image holder of a solid image, and wherein the color image is developed on the latent image holder, and a transfer station for transferring the developed color image to the transfer material.

18. An image forming apparatus as claimed in claim 17, wherein the apparatus further comprises a heat-fixing device to fix the color image to the transfer material.

19. Image forming apparatus capable of use with a transparent toner transferred on a transfer material comprising:

a latent image holder for holding a latent image thereon;

a developer for developing the transparent toner on the latent image in a predetermined amount of the transparent toner, wherein the amount of the developed transparent toner is less than 0.8 mg/cm when a surface roughness Rz of the transfer material is less than 5.0 mm; and a transfer station for transferring the transparent toner to the transfer material.

20. Image forming apparatus capable of use with a transparent toner transferred on a transfer material comprising:

a latent image holder for holding a latent image thereon;

a developer for developing the transparent toner on the latent 5 image in a predetermined amount of the transparent toner, wherein the amount of the developed transparent toner is less than or equal to 0.15·Rz·W; and a transfer station for transferring the transparent toner to the transfer material.

* * * * *